US005458070A

United States Patent [19]

Gamba et al.

[11] Patent Number: 5,458,070

[45] Date of Patent: Oct. 17, 1995

[54] EXTENDIBLE TABLE WITH TWO ROTATING ELEMENTS, FOR USE AS A PIECE OF FURNITURE

[75] Inventors: Arnaldo Gamba, Noale; Anna L. Guerra, Padua, both of Italy

[73] Assignee: NAOS S.R.L., Florence, Italy

[21] Appl. No.: 219,016

[22] Filed: Mar. 28, 1994

[30] Foreign Application Priority Data

Apr. 1, 1993 [IT] Italy ..... FI92U0032

[51] Int. Cl.[6] ..... A47B 1/00

[52] U.S. Cl. ..... 108/66; 108/65

[58] Field of Search ..... 108/66, 65, 86, 108/73, 140, 143, 89, 70, 59

[56] References Cited

U.S. PATENT DOCUMENTS

| | | | |
|---|---|---|---|
| 351,101 | 10/1886 | Fauber | 108/66 |
| 829,439 | 8/1906 | De Simone | 108/66 |
| 3,538,862 | 11/1970 | Patriarca | 108/59 |
| 5,237,937 | 8/1993 | Peltier et al. | 108/66 |
| 5,337,682 | 8/1994 | Wiseman | 108/140 X |

FOREIGN PATENT DOCUMENTS

| | | | |
|---|---|---|---|
| 81105 | 12/1952 | Norway | 108/70 |

*Primary Examiner*—Kenneth J. Dorner
*Assistant Examiner*—Janet M. Wilkens
*Attorney, Agent, or Firm*—McGlew and Tuttle

[57] ABSTRACT

The table comprises two leaves (1) and (2) lying one on top of the other in two parallel and adjacent planes, it being possible to draw the leaves apart in plan view; each leaf is supported by a support arm which is inclined to a greater or lesser degree (4) and (3), the two arms being articulated on a base (5) about axes (X—X) and (Y—Y) which are parallel to one another and orthogonal to the plane of the leaves; a chain transmission (6) in the base (5) kinematically connects the two support arms (4) and (3) together so that they can be moved simultaneously with respect to one another.

15 Claims, 5 Drawing Sheets

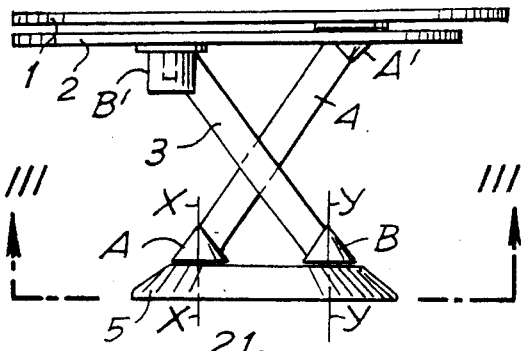
Fig. 1
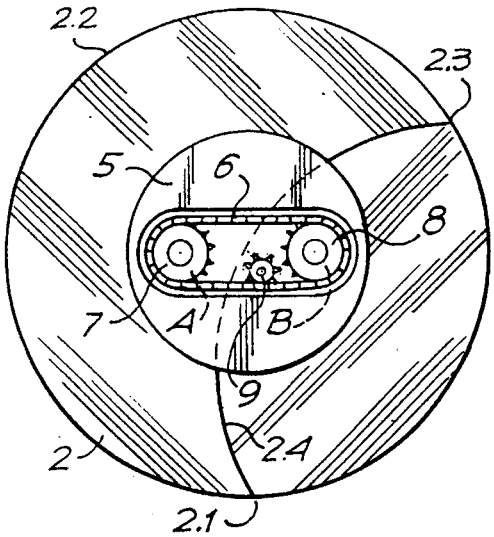
Fig. 3
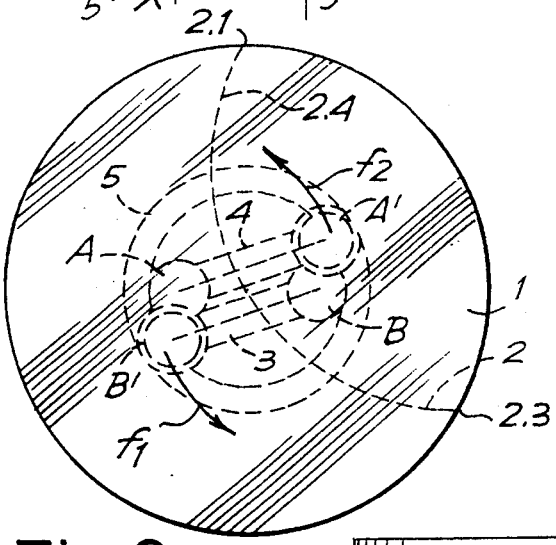
Fig. 2
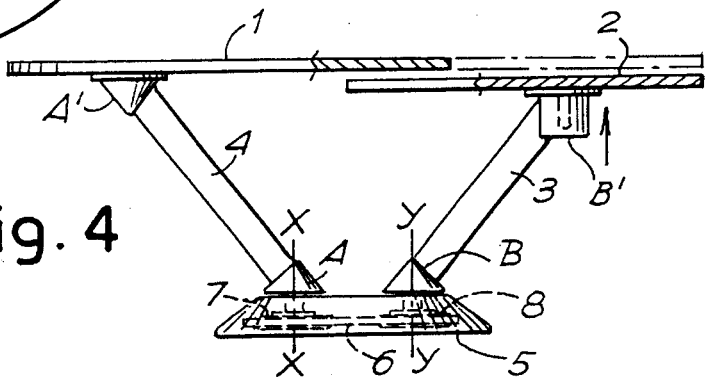
Fig. 4
Fig. 5
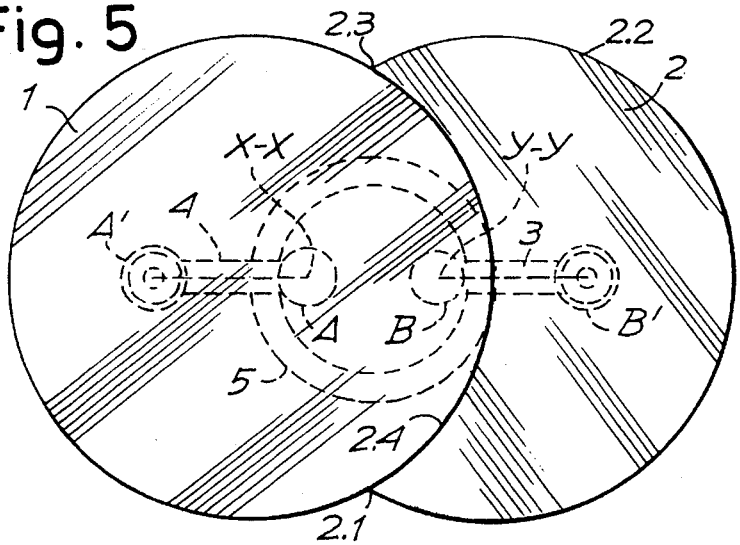

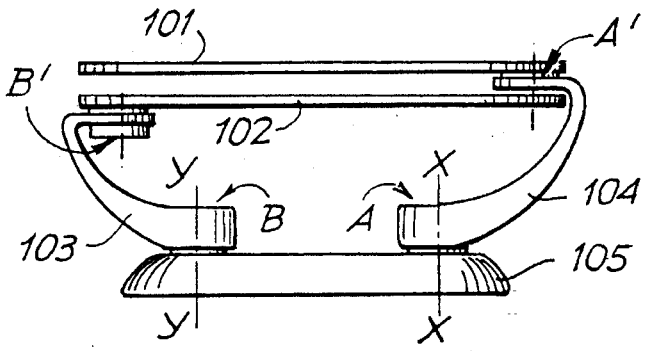
Fig. 6
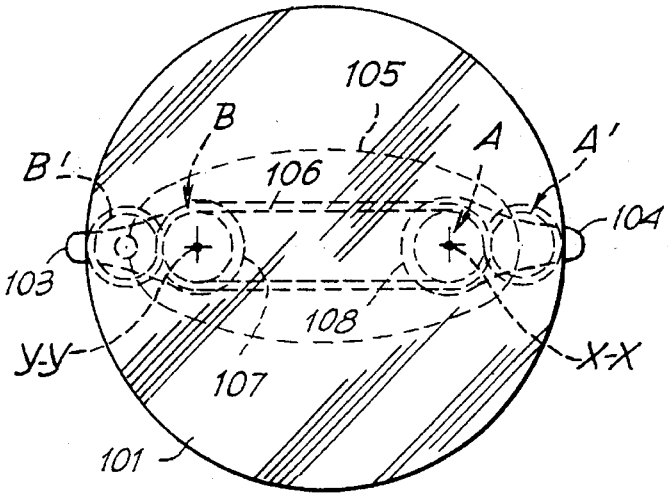
Fig. 7
Fig. 8
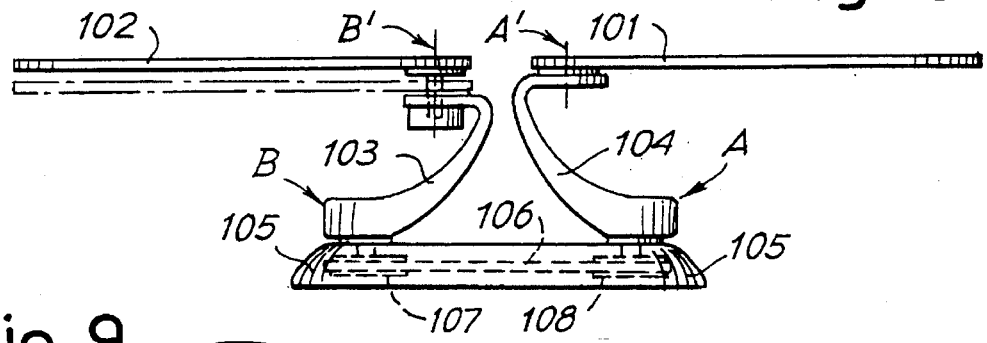
Fig. 9
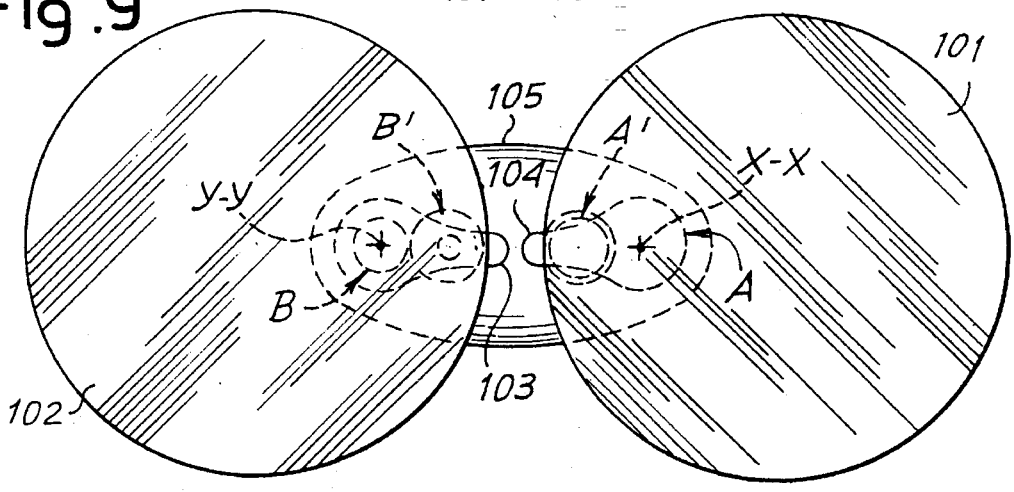

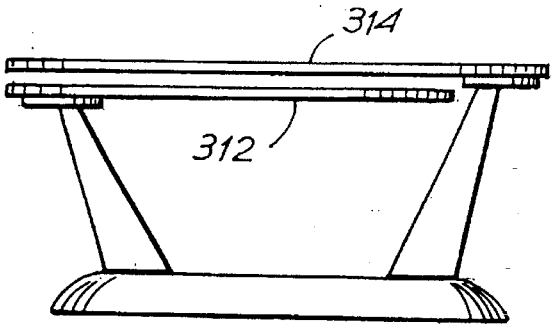
Fig.13
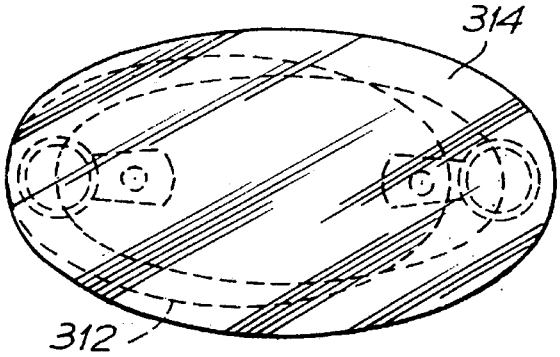
Fig.14
Fig.15
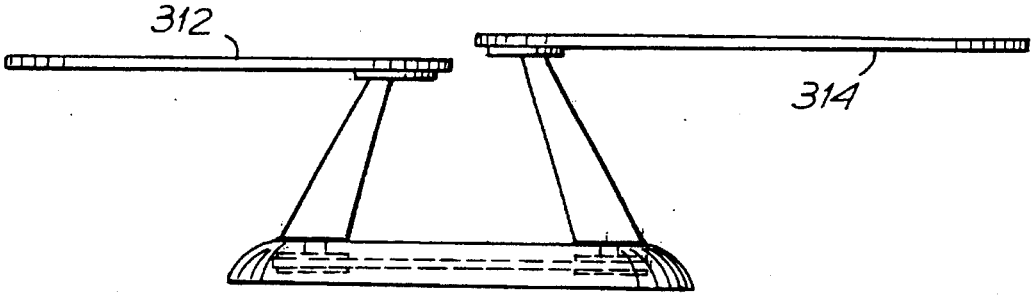
Fig.16
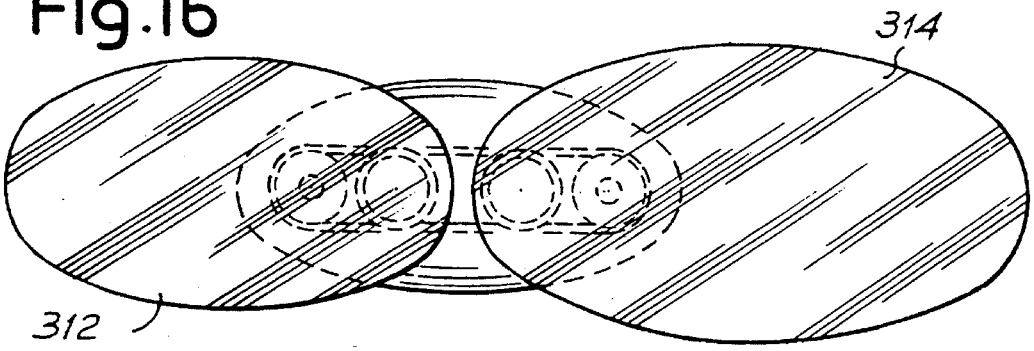

EXTENDIBLE TABLE WITH TWO ROTATING ELEMENTS, FOR USE AS A PIECE OF FURNITURE

FIELD OF THE INVENTION

The present invention relates to a table, the top of which can be extended from a minimum-extension position to a maximum-extension position.

BACKGROUND OF THE INVENTION

Tables whose surface can be varied by adding extra leaves on one or more of their sides are known. In other cases the top of the table is divided into at least two parts which can be pulled apart by sliding them on suitable prismatic guides: In this example, once the parts of the table top have been pulled apart, extra parts can be inserted which fit together with the first two. Other examples involve the rotation and folding of one surface articulated to another surface in the form of a book. With all these solutions the operations involved in changing the table set-up are bothersome and usually entail removing any objects which happen to be on at least one of the two leaves.

SUMMARY AND OBJECTS OF THE INVENTION

The present invention provides a table for use as a piece of furniture, comprising at least two leaves lying at least partially one on top of the other on parallel and adjacent planes, in the minimum-extension position, it being possible to draw said leaves apart in plan view; each leaf is supported by a support arm which is inclined to a greater or lesser degree, the arms being articulated on a base about axes which are parallel to one another and orthogonal to the plane of the leaves; a transmission is provided in the said base in order kinematically to connect the support arms together so that they can be moved angularly simultaneously with respect to one another. Once the leaves have been rotated into the maximum-extension position of the table surface, they can be made to lie in the same plane by vertically moving at least one of them and then locking it in position. The surface shape of the leaves may be such that in the minimum-extension position they lie completely one on top of the other or, alternatively, such that in the maximum-extension position they are juxtaposed with respect to one another, the two surfaces being identical or different, or such that they are not juxtaposed at all.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 and 2 show a lateral view and a plan view respectively of a first embodiment of the table, in the minimum-extension position;

FIG. 3 shows the kinematic transmission connection between the two support arms, in a view along the line III—III of FIG. 1;

FIGS. 4 and 5 show a side view and a plan view respectively of the table of FIG. 1 in the maximum-extension position;

FIG. 6 and 7 show a side view and plan view respectively of a second embodiment of the table, in the minimum-extension position;

FIGS. 8 and 9 show a side view and a plan view respectively of the table of FIG. 7 in the maximum-extension position;

FIGS. 13 to 16 show a modified embodiment with respect to FIGS. 6 to 9, in a side view and in a plan view, with the leaves lying one on top of the other and respectively with the leaves drawn apart;

DETAILED DESCRIPTION OF THE PREFERRED EMBODIMENT

Figure 10:
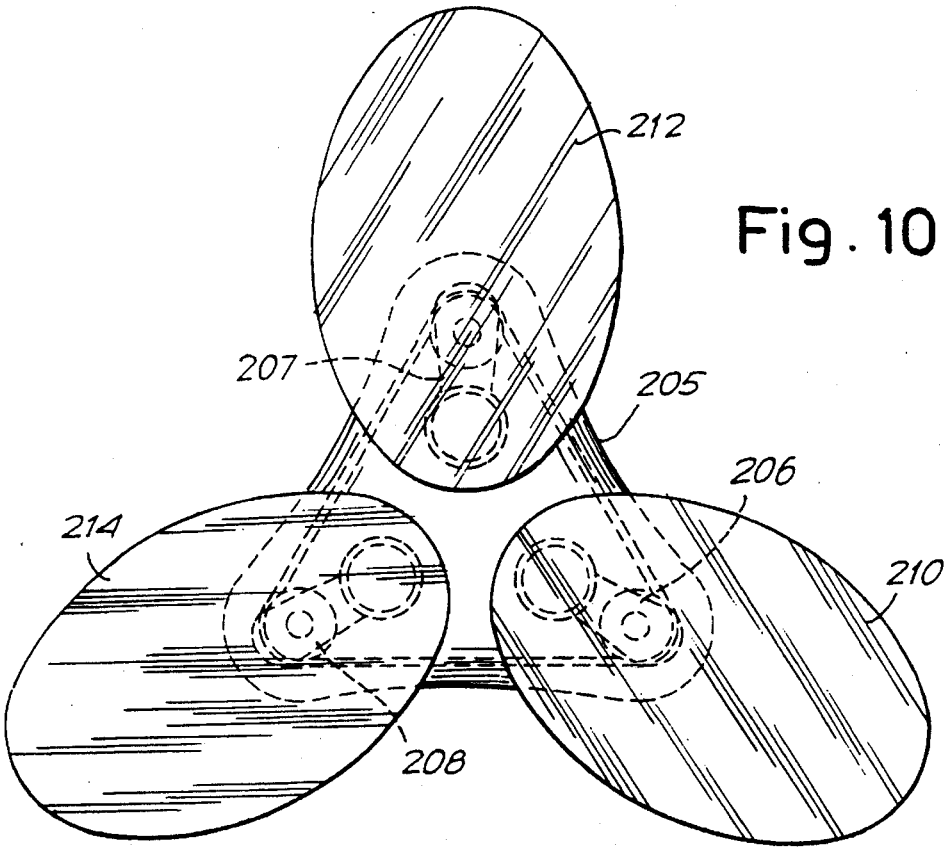
FIGS. 10 to 12 show two plan views of a table with three leaves in open position and in a position in which they lie partially one on top of the other, and a view along the line XII—XII of FIG. 11.

With reference to FIGS. 1 to 5, (1) and (2) indicate the two leaves of the table, the first (1) of which, lying on top of the second, has a circular shape in plan view, whereas the second (2) has a shape delimited by the two arcs of a circle (2.1-2.2-2.3) and (2.1-2.4-2.3) in plan view, in which (2.1) and (2.3) are the points of intersection of the two arcs while (2.2) and (2.4) are any points on the first and on the second arc respectively. These arcs of a circle have approximately the same radius as that of the circle which constitutes the shape of the upper leaf. Each of the two leaves is connected to a support arm or leg, the leaf (1) at point (A') to a leaf end of an arm (4) and the leaf (2) at the point (B') to leaf end of an arm (3) respectively. The two arms (3, 4) have base ends which are articulated on a base (5) at the points (A) and (B) and can rotate about the vertical first and second axes (X—X) and (Y—Y) respectively; in addition their shape and arrangement are such that in the configuration shown in FIG. 1 they appear crossed. In addition to housing the articulation pins for the arms (3, 4) the base (5) also houses a chain transmission consisting of a chain (6) running around two toothed wheels (7) and (8) which have the same pitch diameter, each of these wheels being securely attached to the first and to the second support arms (3, 4) of the leaves respectively. The chain transmission also optionally comprising a tensioning sprocket wheel (9). Therefore by rotating the top leaf (1) in the horizontal plane and in a counterclockwise direction—arrow f1—through an angle equal to or slightly less than 180° , the bottom leaf (2) , driven by the chain transmission, executes a similar rotation in the same direction—arrow f2—and the table assumes the configuration shown in FIG. 4, in which the support arms (3, 4) are pulled apart and their top ends are distanced from one another. The fact that the two leaves are moved simultaneously ensures that a substantially constant equilibrium is maintained, so that the base may have reduced dimensions. Once these movements have been performed, the two leaves (1, 2) assume the position shown in FIGS. 4 and 5; the concave arc (2.3, 2.4, 2.1) now coincides, as shown in FIG. 5, with the periphery of the circular leaf (1). The coupling between the leaf (2) and the support arm (3) is provided with a prismatic guide which slides in a vertical direction, and has a travel such as to enable the leaf (2) to be lifted to the same level as the leaf (1), at which point suitable snap or clamp means, not shown in the figures, lock it into a stable position. The base (5) may also house snap or clamp means which block the rotation of at least one of the support arms in one or more of the positions assumed during rotation.

Suitable release means will be provided to reverse the above operations.

The leaf (2) may be raised using a suitable servomechanism.

FIGS. 6 et seq. show a second embodiment of the invention in which equivalent members are denoted using the same references, increased by "100". This embodiment differs from that previously described in that the two leaves (101, 102)—which may be of the same shape, such as the circular one illustrated—are carried in a cantilevered manner by the corresponding support arms (104, 103), which arms can rotate without crossing each other so as to assume two symmetrical positions.

If the two leaves (101, 102) are of the same shape and/or have same dimensions—at least in the direction defined by the two axes of rotation—for example the circular shape illustrated, the support arm (104) of the top leaf (101) will be shaped so as to pass around the outside of the bottom leaf (102) and not interfere with it, either in the minimum-extension position of the table or during the relative movement of the two leaves.

Figure 12:
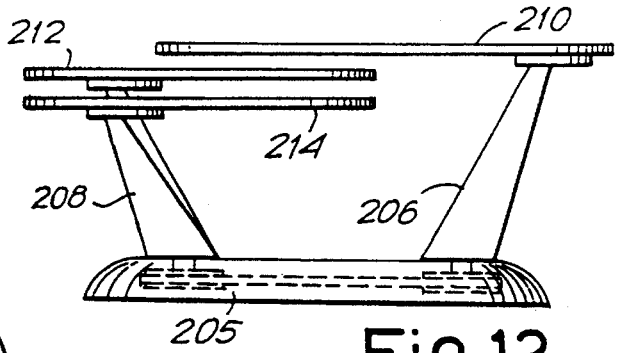
Figure 11:
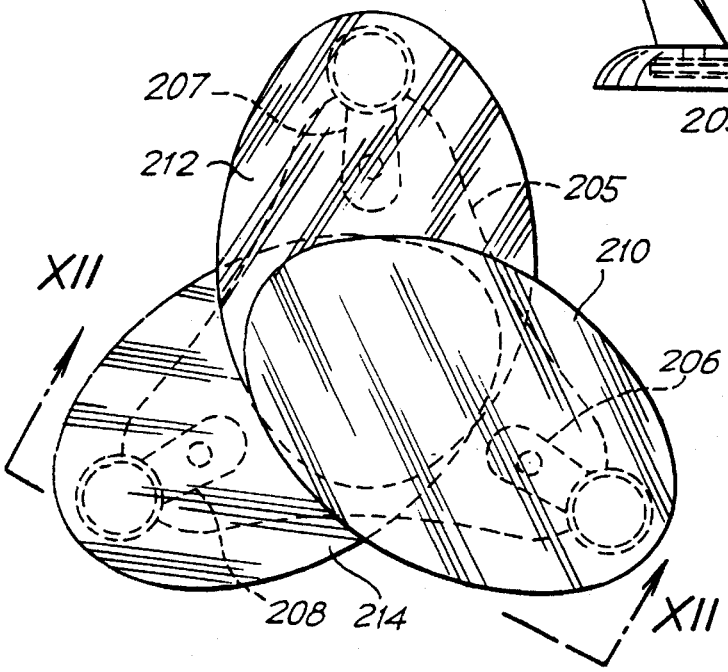

FIGS. 10 to 12 show an embodiment with a base 205 on which there are articulated, according to three vertical axes disposed like the vertexes of an equilateral triangle, as many arms 206, 207, 208, each of which carries a leaf 210, 212, 214, respectively; the three leaves lie on, and are able to move with respect to as many horizontal geometrical planes brought close to each other, to reach positions in which they lie partially one on top of the other and are spaced apart (FIG. 10) or even intermediate positions. The displacement of each of the three leaves is simultaneous to that of the others, and may be of 180° between a position in which they lie towards, and above, the geometrical centre of the base 205, and a position in which they protrude outwards.

FIGS. 13 to 16 show an embodiment similar to that of FIGS. 6 to 9, but in which one of the two leaves 312 and 314—which are oval instead of circular—has smaller dimensions than the other; in particular. It is the leaf 314 lying on top of leaf 312 which is of greater dimensions.

Figure 18:
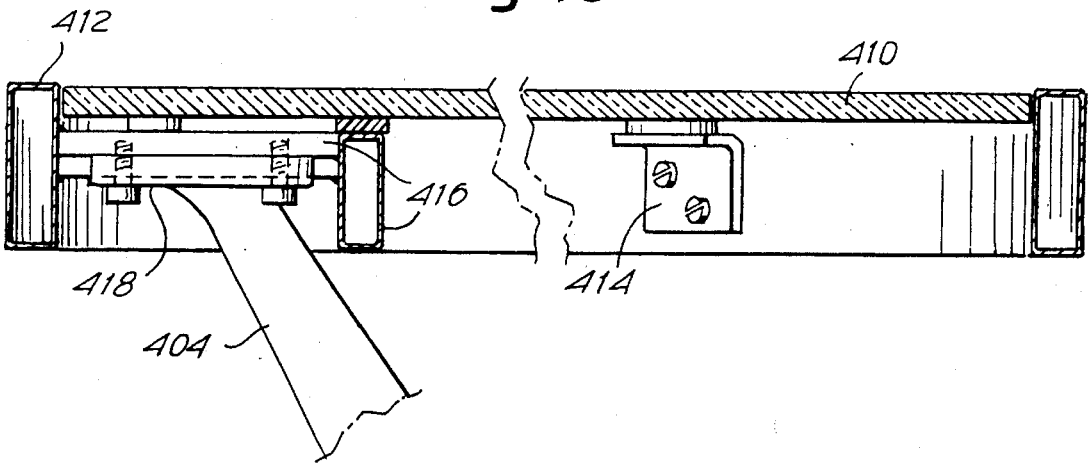
FIGS. 17 and 18 show an embodiment with a crystal leaf provided with a perimetric frame, in plan view and in section on line XVIII—XVIII of FIG. 17.
Figure 17:
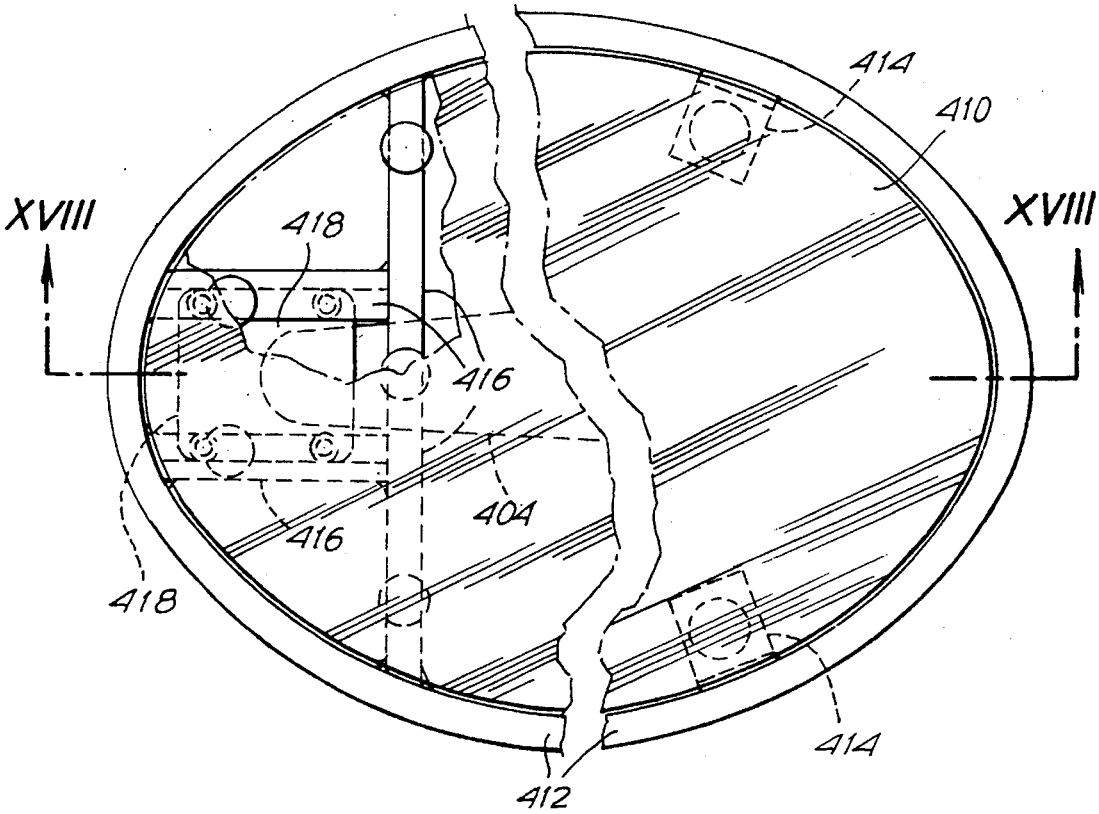

In the FIGS. 1 to 16, the leaves are in form of sheets, such as, and especially, of crystal sheets. FIGS. 17 and 18 show an embodiment wherein—instead of a thick crystal leaf, as in the previous embodiments— a relatively thin crystal leaf 410 is provided which is supported by a frame 412, for example through brackets 414 and cross-pieces 416, to which a plate 418 for the arm 404 is also solid.

We claims:

1. A table comprising:

a first leaf;

a base spaced from said first leaf;

a first leg having a base end rotatably connected to said base about a first axis substantially perpendicular to said first leaf, said first leg having a leaf end connected to said first leaf and being spaced from said first axis to cause rotation of said first leaf about said first axis in an arc when said first leg is rotated;

a second leaf spaced from said base;

a second leg having a base end rotatably connected to said base about a second axis substantially perpendicular to said second leaf, said second leg having a leaf end connected to said second leaf and being spaced from said second axis to cause rotation of said second leaf about said second axis in another arc when said second leg is rotated;

transmission means positioned in said base and for kinematically connecting said first leg and said second leg to have rotation of one of said first and second legs cause rotation of another of said first and second legs.

2. A table in accordance with claim 1 wherein:

said first and second legs are positioned with respect to each other and said first and second leaves to cause rotation of said first and second legs about said first and second axes to move said first and second leaves from a first position to a second position, said second position having said first and second leaves further extended from each other than said first position.

3. A table in accordance with claim 2, wherein:

said first and second leaves are overlapped in said first position, and said first and second leaves are not overlapped in said second position.

4. A table in accordance with claim 2, wherein:

said first and second legs extend from an outer edge of said base towards an inside of said base when said first and second leaves are in said first position;

said first and second legs extend outward from said base when said first and second leaves are in said second position.

5. A table in accordance with claim 2, wherein:

said first and second leaves each have a portion complimentary to each other, and said portions are positioned adjacent each other in said second position.

6. A table in accordance with claim 2, wherein:

said first and second legs are positioned substantially symmetrical in said first and second positions.

7. A table in accordance with claim 2, wherein:

said first leg has a curved shape;

said second leaf has a portion positioned between said leaf end and said base end of said first leg, when said first and second leaves are in said first position.

8. A table in accordance with claim 1 wherein:

said first and second legs are connected by said transmission means to cause rotation of said first and second legs about said first and second axes to move said first and second leaves from a first position to a second position, said second position having said first and second leaves further extended from each other than said first position.

9. A table in accordance with claim 1, wherein:

said leaf end of said first leg is rotationally fixed to said first leaf;

said leaf end of said second leg is rotationally fixed to said second leaf;

said first and second axes are substantially parallel;

said first and second leaves are substantially parallel to each other;

said base bears directly on a floor;

said base is substantially parallel to said first and second leaves;

said first and second legs, said first and second leaves and said transmission means are related to maintain an equilibrium of the table substantially constant during rotation of said first and second legs;

said first and second axes are fixed at said base.

10. A table in accordance with claim 1, wherein:

said transmission means rotates said another one of said legs in a same rotational direction as said one of said legs.

11. A table in accordance with claim 1, wherein:

said transmission means includes a chain wheel fixed to each of said first and second legs, said transmission means also includes a chain connected to said chain wheels.

12. A table in accordance with claim 1, wherein:

said first leaf is movable into and out of a plane of said second leaf.

13. A table in accordance with claim 1, further comprising:

a third leaf spaced from said base;

a third leg having a leaf end connected to said third leaf and having a base end rotatably connected to said base about a third axis substantially perpendicular to said third leaf, said leaf end of said third leg being spaced from said third axis, said transmission means kinematically connecting said third leg to said first and second legs to have rotation of one of said legs cause rotation a remainder of said legs, each of said legs being rotatable about substantially 180 degrees, and said leaves being shaped to rotate said leaves from a first position having said leaves extending toward a center of said base to a second position having said leaves extending away from said base.

14. A table in accordance with claim 1, wherein:

said first and second leaves are formed as a plate supported directly by a respective leg.

15. A table in accordance with claim 1, wherein:

said first and second leaves are formed as a sheet supported by a frame, said frame being supported by a respective leg.

* * * * *